United States Patent [19]

Behar

[11] Patent Number: 4,969,579

[45] Date of Patent: Nov. 13, 1990

[54] AEROSOL SPRAYER DEVICE AND METHOD OF USING SAME

[75] Inventor: Alain Behar, Eu, France

[73] Assignee: Societe Francaise d'Aerosol et de Bouchage, Friville-Escarbotin, France

[21] Appl. No.: 412,620

[22] Filed: Sep. 25, 1989

Related U.S. Application Data

[63] Continuation of Ser. No. 153,183, Feb. 8, 1988, abandoned.

[30] Foreign Application Priority Data

Feb. 9, 1987 [FR] France ..... 87 01519

[51] Int. Cl.[5] ..... B65D 83/14

[52] U.S. Cl. ..... 222/136; 222/1; 222/135; 222/145; 222/183; 282/399; 282/402.17

[58] Field of Search ..... 222/1, 129, 131, 135, 222/136, 145, 183, 94, 137, 399, 144.5, 400.7, 402.16, 402.17, 402.18; 239/304, 308, 354

[56] References Cited

U.S. PATENT DOCUMENTS

| | | | |
|---|---|---|---|
| 3,181,737 | 5/1965 | Chaucer | 222/136 |
| 3,291,348 | 12/1966 | Chibret et al. | 222/145 |
| 3,343,718 | 9/1967 | Siegel et al. | 222/136 X |
| 3,698,453 | 10/1972 | Morane et al. | 222/136 X |
| 4,469,252 | 9/1984 | Obrist | 222/399 X |
| 4,593,836 | 6/1986 | Lilienthal | 222/136 |
| 4,613,061 | 9/1986 | Meuresch et al. | 222/135 X |
| 4,635,822 | 1/1987 | Klawitter | 222/136 X |

FOREIGN PATENT DOCUMENTS 8405841 5/9187 Fed. Rep. of Germany .

*Primary Examiner*—Kevin P. Shaver
*Attorney, Agent, or Firm*—Pennie & Edmonds

[57] ABSTRACT

An apparatus for storing and combining at least two discreetly stored chemical compositions to form a mixture or a reaction product and to dispense the mixture or reaction product therefrom. The apparatus comprises at least a first receptacle and a second receptacle, each configured for operation with a corresponding aerosol valve and a connecting bridge member configured for operative gas-tight association with each aerosol valve. The first receptacle contains a first component, stored therein under a substantially positive internal pressure, which is permitted to flow along a path extending through the bridge member into the second receptacle wherein it is mixed or reacted with the second component and subsequently sprayed through a spray nozzle located at an end of the bridge member. A method for using an apparatus of the type described above which comprises aligning a 3 way valve within the bridge member to form a transfer groove connecting the receptacles; exerting a force upon the bridge member to simultaneously open the valves of each receptacle to permit the first component to enter the second receptacle; realigning the 3 way valve to communicate the second receptacle with the spray nozzle and pressing the bridge member down to open the valve upon the second receptacle, thereby permitting the contents thereof to be dispensed through the nozzle as an aerosol spray.

27 Claims, 2 Drawing Sheets

AEROSOL SPRAYER DEVICE AND METHOD OF USING SAME

This is a continuation of application Ser. No. 07/153,183, filed Feb. 8, 1988, now abandoned.

TECHNICAL FIELD

The invention relates to a sprayer device suitable for transport and storage of at least two component compositions combinable to form a mixture or a reaction product having a relatively short "shelf life". More particularly, the sprayer device of the invention is capable of combining two separately stored compounds and then dispensing the resultant mixture or reaction product in the form of an aerosol spray.

BACKGROUND OF THE INVENTION

A number of chemical preparations suffer from a progressive deterioration of their properties over time. This deterioration is due to the effect of various physical and chemical changes caused, for example, by processes such as drying, oxidation, cross reactions and polymerization. These preparations are therefore most effective when they are prepared no more than a short time prior to their intended use. Examples of compositions which fit this description include many types of adhesives, as well as other products having a limited "shelf life", particularly materials having a medicinal effect.

Various processes have been described for obtaining, when required, a mixture of two constituent materials to form compositions of the type described above. The most convenient method to obtain such a combination is to divide the preparation into two components, wherein a first portion is in the form of a liquid which acts as a solvent and the second portion may be present as, for example, a solid dispersed in the form of a powder.

It is also known to produce various products, such as perfumes and insecticides, in an aerosol form. These aerosols may be obtained by the discharge of a gas or a supporting liquid such as nitrogen, butane or a fluorocarbon composition. This permits these products to be delivered in small doses, e.g., as a very fine spray.

Such products are often packaged in aerosol containers or bottles provided with a valve of relatively small size. The valve is operatively associated with a tubular control stem to serve as an atomizer, upon which is seated a push button of variable structure. This push button normally carries a spray nozzle for dispensing the product. Devices of this type are often utilized, for example, to contain and deliver various types of medicaments, including those most often intended for treatment of respiratory difficulties, such as those involving the bucco-pharyngile and/or pulmonary ducts.

SUMMARY OF THE INVENTION

Applicant has now invented a novel apparatus suitable for transporting, storing, and subsequently mixing various components to form a final product, and thereafter dispensing this product for later use in a variety of applications. The device in question generally comprises an assembly utilizing two receptacles closed by aerosol valve means, together with a bridge member configured and adapted for connecting the two atomizing units in a rigid, gas-tight manner.

In use, a first one of the aforementioned receptacles normally contains a first component dispersed in a liquid medium at a substantially positive internal gas pressure. This first component may, for example, be placed in solution in the carrier gas. The remaining receptacle is typically adapted to contain a second component in an inert gas under a reduced pressure. If desired, the second receptacle may be substantially evacuated so as to maintain the component therein under a vacuum.

Applicant's aerosol assembly is constructed to operate in two stages: The first stage entails mixing the two components together while the second stage comprises dispensing the resultant mixture or reaction product. The purpose of the bridge member, therefore, is to permit communication between the two receptacles by simultaneously pressing a corresponding aerosol valve means for each.

This action permits a portion of the first component, mixed with a volume of the carrier gas under a positive internal pressure, to be transferred to the second receptacle and to be mixed therein with the contents of the container until the pressures in each receptacle are equalized. Thereafter, upon permitting a certain waiting or storage time to pass, it is possible, by opening a duct which communicates with the external environment, to dispense from the device the mixture or reaction product through, for example, a spray nozzle, so as to permit its use for the intended application.

In its simplest form, the bridge member may comprise a duct having two opposed openings, each provided with a female connector, which would then be replaced upon the second receptacle with a known type of head. In certain instances, it would then be left in place to serve as a head in the reverse direction, after the first receptacle is removed. In the preferred embodiment, the bridge member is provided with a spray atomizer.

The placing of such an atomizer, however well designed, on the connecting channel, would reduce the extent of the transfer between the two receptacles. This would also have an effect on the turbulence created by this transfer and would most likely negatively affect the efficiency of the mixing. On the other hand, mounting such an atomizer on a branched portion of the bridge member would be likely to lead to losses during the transfer.

The assembly described above further requires that one of the receptacles should be employed in an upside-down position. It must therefore be provided with an internal tubeless valve. In view of these requirements, applicant has determined that, to avoid error in the operation of the assembly, leading to unsatisfactory results, it is more advantageous to utilize two similar receptacles placed side by side during the transfer. This arrangement entails the use of a U-shaped connecting member which permits the user to interrupt the flow of the product without dismantling the unit.

It is therefore possible to utilize a connecting bridge member having three flow paths, one leading to the first receptacle, which is open during the transfer but which is then shut off; a second leading toward the second receptacle, which is maintained in an open position only while its valve is open and a third path for discharging the resultant mixture or reaction product, said path being opened by auxiliary means during a spraying operation.

The dispensing channel may be closed initially only by a single cover, which is removed for dispensing. The presence of the first receptacle serves to block the orifice of the transfer channel during this step, but it is more convenient and more reliable (and requires little additional expense) to open and close the two ducts in turn by a valve, preferable a three-way valve. This requires the use of only a single moveable valve and this arrangement is therefore preferred. Advantageously, applicant's aerosol device is constructed using different sized receptacles to prevent any error in assembling the device.

Other characteristics and advantages of the present invention will become apparent from a review of the detailed description given below, with reference to the attached drawing figures.

DETAILED DESCRIPTION OF THE PREFERRED EMBODIMENTS

Figure 1:
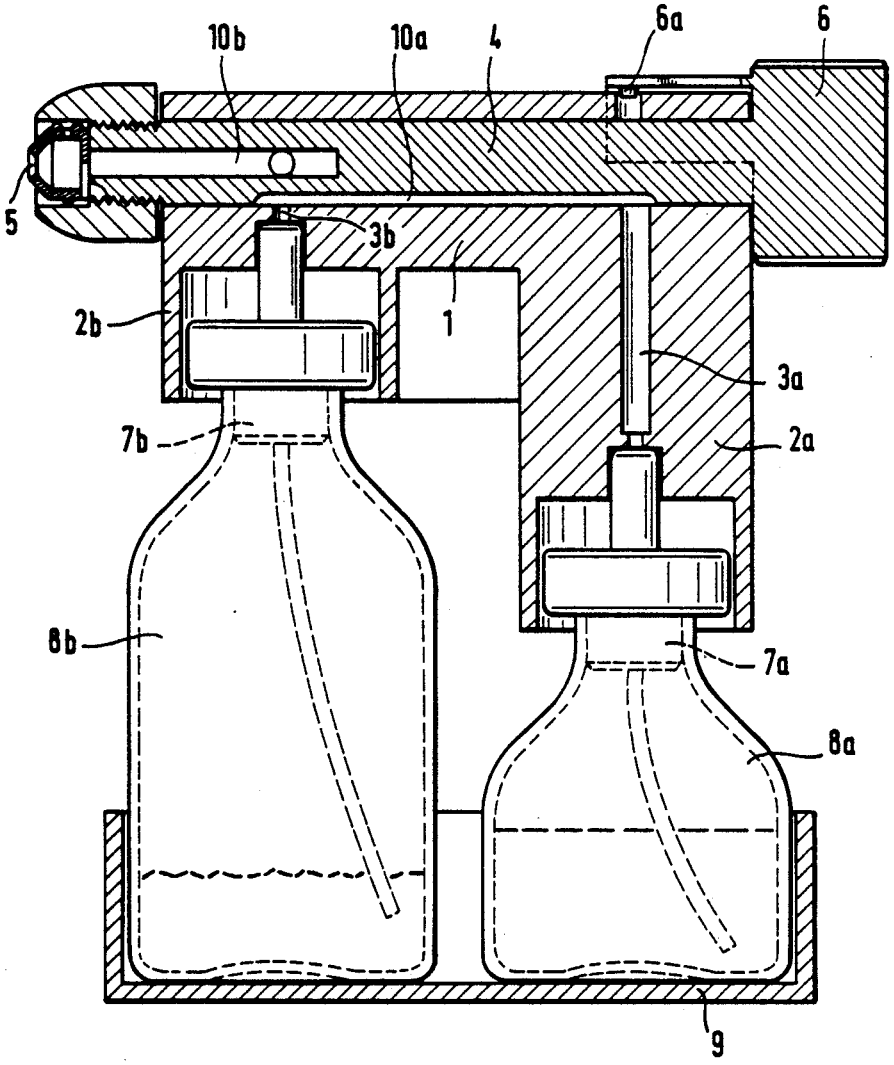
FIG. 1 is a sectional elevational view of applicant's sprayer utilizing a three - position bridge member.

Referring initially to FIG. 1, the bridge member illustrated therein has the structure of a simple 3-way valve. Body portion 1 of the bridge member forms a housing defining a pair of apertures, 2*a* and 2*b*, which have axes parallel to and communicating with juxtaposed channels 3*a* and 3*b*. The bridge member is constructed with a bore configured and adapted for receiving key 4 provided with spray nozzle 5. Operating button 6, located opposite nozzle 5, serves to align key 4 at first and second operating positions. In the subject illustration, key 4 is shown in a transverse orientation.

The seat portion of each of apertures 2*a*, 2*b* is configured and adapted to fit upon a standard atomizer used with valves 7*a* and 7*b*. Each of these atomizer valves 7*a* and 7*b* is provided with a cylindrical tube member 23, 24 extending into a corresponding bottle 8*a*, 8*b* adapted for containing an aerosol material. Channels 3*a*, 3*b* are preferably of different lengths to permit the bottom of bottles 8*a*, 8*b* to rest on a single, flat surface despite their difference in height. This size difference is attributable to the fact that the first bottle 8*a* has a lesser capacity than that of the second bottle 8*b*.

Key 4 is provided with longitudinal transfer groove 10*a* as well as distribution duct 10*b*, which is in fluid communication with spray nozzle 5. Longitudinal transfer groove 10*a*, when aligned in a first position, i.e., that shown in FIG. 1, connects the internal orifices of channels 3*a* and 3*b* which extend through corresponding aperture 2*a* and 2*b*. When key 4 is rotated to a second position, therefore, distribution duct 10*b* opens in its turn to communicate with channel 3*b* extending through aperture 2*b*. To further define these two operating positions, two abutments, i.e., operating as cams, may be provided as at 6*a* extending downwardly, between the skirt of operating button 6 and body portion 1 of the casing and formed integral with said skirt. Thus, abutments 6*a* serve as stop catches to retain key 4 at the desired position within the bridge member.

Body portion 1 serves as a press member and the operator, in pushing body portion 1 toward bottles 8*a* and 8*b*, opens both valves 7*a* and 7*b*. When key 4 is initially oriented in the position illustrated in FIG. 1, the vector gas transfers the major portion of the contents of bottle 8*a*, which are stored therein under a substantially positive internal pressure, to bottle 8*b* through groove 10*a*. When key 4 is thereafter turned to a second position, a further pressure exerted on body portion 1 permits the contents of bottle 8*b* to flow toward the exterior through channel 10*b* and spray nozzle 5.

Numerous alternate embodiments of this design are, of course, possible using, for example, a sleeve member mounted for rotation or even for helicoidal motion to obtain an improved gas-tight connection, both in the connecting axis and also in the axis of valve 7*b* of bottle 8*b*.

Figure 2:
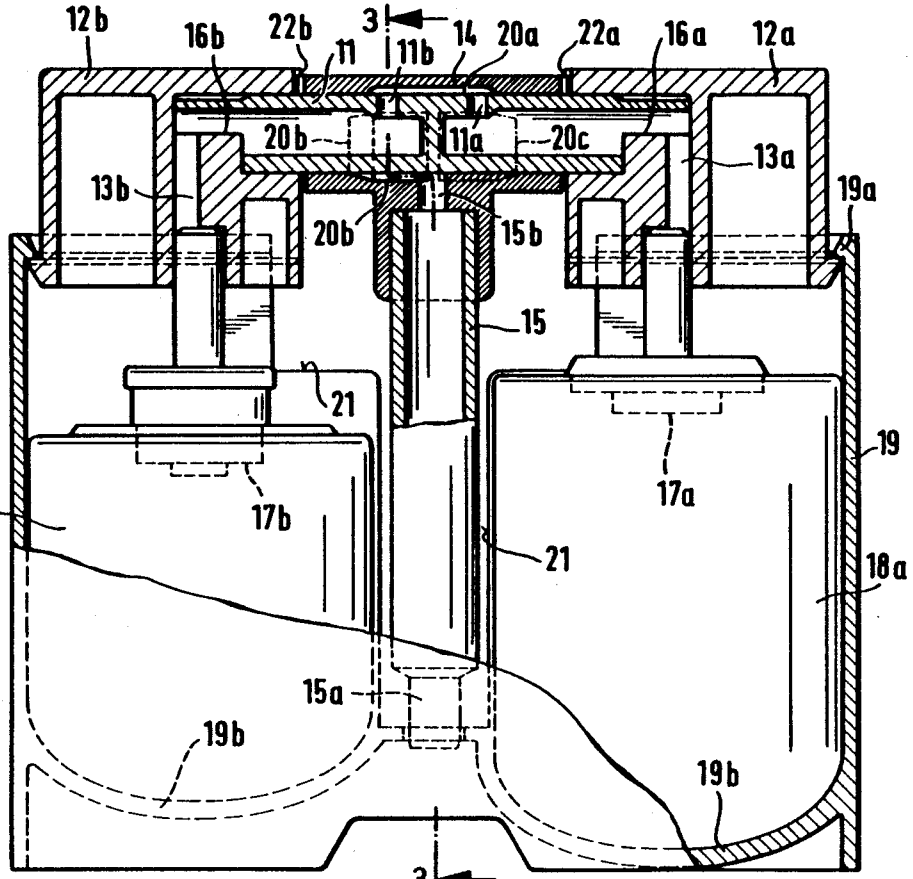
FIG. 2 is a sectional elevational view of an alternate embodiment of the device illustrated in FIG. 1, having a bridge comprising an assembly of three members.
Figure 3:
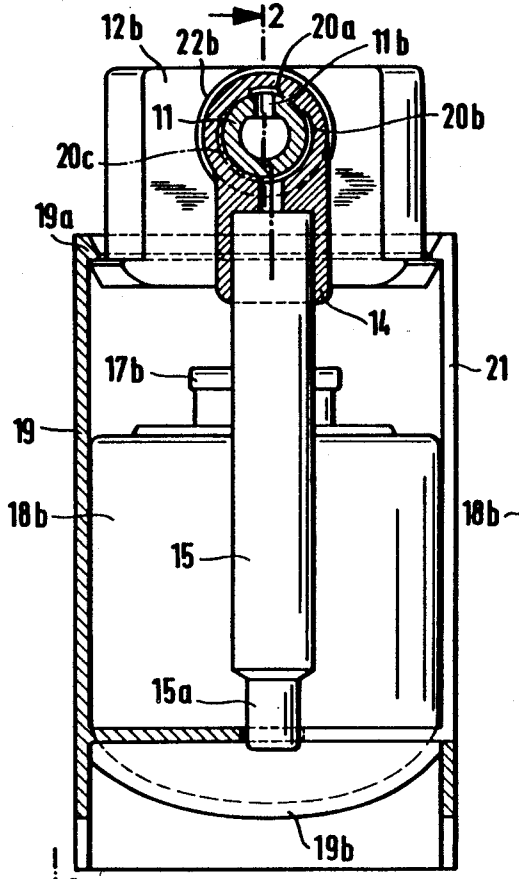
FIG. 3 is a transverse sectional view of the device of FIG. 2 taken along the line 3—3 of FIG. 2.

Turning now to FIGS. 2 and 3, the bridge member illustrated therein also forms a three-way valve. This alternate embodiment comprises joining conduit 11 which engages the lateral output orifices of each of a pair of heads 12*a*, 12*b*, so as to form a connection at a right angle to their internal channels 13*a*, 13*b*. Conduit 11 passes through the bore of sleeve 14 and is provided with a nozzle member such as nozzle 15*a* of duct 15.

In addition, members 16*a*, 16*b* serve to maintain the axes of heads 12*a*, 12*b* in a parallel, side by side relation. Tubeless valves 17*a*, 17*b* are adapted at their seats to two complementary cartridges 18*a*, 18*b*, of which the first cartridge, i.e., 18*a*, is pressurized. Cartridges 18*a*, 18*b* are enclosed in casing 19, which is provided with flange 19*a* for engaging and retaining a complementary flange located upon each head 12*a* and 12*b*. In the subject embodiment, a difference in the depth of the bottom portion 19*b* of casing 19 compensates for the difference in length of the cartridges 18*a*, 18*b*. In the above-described embodiment, valve 17*b* serves as a metering valve.

The internal bore of conduit 11 is divided by a central barrier member into two spaces opening laterally at two adjacent orifices 11*a*, 11*b*, shown for purposes of illustration in the same diametral plane. Sleeve 14, which turns on conduit 11 with a minimal amount of friction, has two internal apertures 20*a*, 20*b*. Longitudinal aperture 20*a* provides a communication between orifices 11*a*, 11*b*. Alternately, aperture 20*b* may be L-shaped or transversely oblique and positioned before the plane of the drawing figure. Aperture 20*b* is thus capable of communicating between orifice 11*b* and 15*b* of duct 15.

When it is desired to combine the contents of cartridges 18*a* and 18*b*, duct 15, which is transversely separated relative to the axis of tube 11, is withdrawn into aperture 21, formed between the two cartridges 18*a*, 18*b* on the side of casing 19. Aperture 20*a* then opens a passage between valves 17*a* and 17*b*. When it is desired to spray the mixture from nozzle 15*a*, duct 15, comprising nozzle 15*a*, is rotated out of aperture 21, until duct 11 abuts against one of members 22*a*, 22*b*. At this point, valve 17*b* then communicates to the exterior through aperture 20*b*.

The dissymmetrical construction of duct 11 and its mounting serve to prevent any mistake in assembling or operating the unit. Alternately, when sleeve 14 is constructed in a symmetrical manner, it would be desirable to raise aperture 20*b* and 20*c* to a higher plane (shown in phantom) in order to obtain a structure effectively symmetrical relative to the vertical axis of the assembly. This is done so that the manner of mounting would not make any difference to the operability of the unit.

In an alternate embodiment of the invention sleeve 14 is mounted in a manner such that it is capable of a sliding motion. This arrangement, however, would likely have a negative effect upon the gas-tightness of the apparatus. Alternatively, in place of a sliding sleeve arrangement, the apparatus could be provided with a push bar or member, having an axis which is parallel to those of cartridges 18*a*, 18*b* optionally controlled by elastic means such as a spring. Thus, by pressing upon the surface of the push member, the contents of cartridge 18*a* would be transferred to cartridge 18*b*. Subsequently, by pressing the apparatus once again, it could be set to spray the contents of cartridge 18*b*.

In a further embodiment, a tamper-proof casing may be placed on sleeve 14, optionally between the bridge member and the casing 19, providing that casing 19 is first modified to permit the introduction of cartridges 18*a*, 18*b* from below.

While it is apparent that the invention herein disclosed is well calculated to fulfill the objects above stated, it will be appreciated that numerous modifications and embodiments may be devised by those skilled in the art and it is intended that the appended claims cover all such modifications and embodiments as fall within the true spirit and scope of the present invention.

I claim:

1. A sprayer device comprising:

(a) first and second receptacles configured and adapted to contain, respectively, a first and a second composition, said first receptacle containing said first composition under a substantially positive internal pressure and said second receptacle containing said second composition under a comparatively lower internal pressure, said compositions being maintained within said receptacles at said positive internal pressure and said lower internal pressure, respectively by corresponding valve means operatively associated with each said receptacle;

(b) said corresponding valve means comprising a first valve means associated with said first receptacle and a second valve means associated with said second receptacle, said first and said second valve means adapted for controlling a flow of said first and said second composition from respectively, said first and said second receptacle, each said valve means being at least partially inserted within a neck portion of a corresponding one of said receptacles in a manner so as to achieve a gas-tight connection therebetween; and (c) a bridge member forming a liquid tight passageway between said first and said second valve means, said bridge member also capable of forming a liquid tight passageway between said second valve means and a spray nozzle located upon a first terminal portion of said bridge member;

(d) said bridge member adapted to permit a flow of said first composition from said first receptacle into said second receptacle to form a mixture therein with said second composition and thereafter to dispense said mixture from said second receptacle through said spray nozzle.

2. The device according to claim 1 wherein said bridge member comprises a three-way valve having a first position providing for fluid communication between said first and said second valve means, a second position to permit dispensing said mixture from said second receptacle through said spray nozzle and a third closed position.

3. The device according to claim 2 wherein said bridge member comprises:

(a) a body portion forming a housing which defines first and second valve seats adapted and configured for operatively engaging, respectively, said first and said second valve means, each said valve seat communicating with corresponding channel means configured for directing a fluid flow out of said first and said second valve means, each said channel means extending substantially perpendicularly from said valve seat to said three-way valve, the vertical axis of both said channel means being in substantially parallel alignment with each other; and (b) said three-way valve further comprising a rotatable key member inserted within a bore defined by said body portion, of said bridge member, said key member being rotatable to said first position to allow said first composition to pass out of said first receptacle through said first valve means and to enter said second receptacle through said second valve means to permit the formation of a mixture therebetween, and, thereafter, to said second position to permit said mixture to exit said second receptacle through said second valve means and to subsequently be dispensed from said device through said spray nozzle.

4. The device according to claim 3 wherein said key member comprises:

(a) a longitudinal transfer groove configured for simultaneous fluid communication with said first and said second valve means when said key member is aligned at said first position;

(b) a distribution duct adapted to be in fluid communication at a first end thereof with said second valve means when said key member is rotated to said second position, said distribution duct communicating at a second end thereof with said spray nozzle on said terminal portion of said bridge member; and (c) an operating button located at a second terminal portion of said bridge member, opposite said spray nozzle, adapted for rotating said key member to said first and said second operating positions.

5. The device according to claim 4 wherein said bridge member further comprises at least one stop cam member formed integral with a skirt portion of said operating button and extending downwardly therefrom into a groove defined by the body portion of said bridge member, said at least one stop cam member being adapted to define said first and said second positions of said key member.

6. The device according to claim 4 wherein each said valve means comprises:

(a) an atomizer configured for insertion within said corresponding valve seat and operated by a downward pressure applied to said body portion of said bridge member, which causes a corresponding valve to open and thus permits the composition within the corresponding receptacle to exit said receptacle through the channel means communicating with said valve seat and to flow into said longitudinal transfer groove when said key member is in said first position or said distribution duct when said key member is in said second position; and (b) an elongated cylindrical tube member having a first end and a second end, said first end being attached to said valve and said second end extending into a corresponding one of said receptacles and terminating substantially adjacent a bottom portion thereof.

7. The device according to claim 1 wherein said second receptacle is substantially larger than said first receptacle to provide a sufficient available volume within said second receptacle for entry of said first composition upon the operation of said device.

8. The device according to claim 1 wherein said first composition is initially dispersed within a liquid medium prior to placing it in said first receptacle, said dispersion being subsequently entrained in a carrier gas within said first receptacle to facilitate its transport to said second receptacle.

9. The device according to claim 1 wherein said second composition is maintained within said second receptacle under vacuum conditions.

10. A sprayer device for storing and combining two discretely separated chemical compositions to form a mixture thereof and to dispense said mixture from said device, said device comprising:

(a) first and second bottles configured and adapted to contain, respectively, a first and a second chemical composition, said first bottle containing said first composition under a first pressure condition and said second bottle containing said second composition under a second condition, said second pressure being lower than said first pressure and said first and second pressure conditions being respectively maintained by corresponding valves operatively associated with said bottles;

(b) said corresponding valves comprising a first aerosol valve associated with said first bottle and a second aerosol valve associated with said second bottle, said first and said second aerosol valves inserted within a neck portion of said first and second bottles respectively, in a manner so as to achieve a gas-tight connection therebetween; and (c) each said first and said second aerosol valves comprising an atomizer configured for insertion within a valve seat portion of a bridge member for connecting said first and said second bottles in operative association, said atomizer thereafter being operated by a downward pressure applied to a body portion of said bridge member to cause said first and said second aerosol valves to open and thus to permit the composition within the corresponding receptacle to exit therefrom and enter a path defined by one of either a longitudinal transfer groove or a distribution duct; and (d) an elongated cylindrical tube member having a first and a second end, said first end being attached to said first or said second aerosol valve and said second end extending into a corresponding one of said bottles and terminating substantially adjacent to a bottom portion thereof; and (e) said bridge member forming a liquid-tight connection between said first and said second aerosol valves and comprising:

(i) said body portion forming a housing which defines first and second valve seats adapted and configured for operatively engaging, respectively, said first and said second aerosol valves, each said valve seat communicating with a corresponding channel extending substantially perpendicularly therefrom to a rotatable key member insertable within a bore defined by said body portion of said bridge member, a vertical axis of both said channels being in substantially parallel alignment; and (ii) a rotatable key member inserted within said bore defined by said body portion for selecting said path, said key member being rotatable to a first position within said bridge member to allow said first composition to pass out of said first bottle through said first aerosol valve and to enter said second bottle through said second aerosol valve to permit the formation of a mixture therebetween, and thereafter to a second position to permit said mixture to exit said second bottle through said second aerosol valve and to subsequently be dispensed from said device through said spray nozzle, said key member including (a) said longitudinal transfer groove configured for simultaneous fluid communication with said first and said second aerosol valves when said key member is aligned at said first position;

(b) said distribution duct adapted to be in fluid communication at a first end thereof with said second aerosol valve when said key member is rotated to said second position, said distribution duct communicating, at a second end thereof, with said spray nozzle located upon a first terminal portion of said bridge member; and (c) an operating button located at a second terminal portion of said bridge member, opposite said spray nozzle, adapted for rotating said key member to said first and said second operating positions, and (iii) at least one stop cam member formed integral with a skirt portion of said operating button and extending downwardly therefrom into a groove upon the body portion of said bridge member, said at least one stop cam member adapted to define said first and said second operating positions of said key member.

11. A method for operating the sprayer device of claim 10 which comprises:

(a) aligning said key member to said first position so as to place said longitudinal transfer groove in fluid communication with both said first and said second aerosol valves;

(b) exerting a sufficient downward force upon said body portion of said bridge member to simultaneously open said first and said second aerosol valves for a sufficient time to permit said first chemical composition to flow out of said first bottle through said first aerosol valve, and to thereafter flow through said transfer groove so as to enter said second bottle through said second aerosol valve such that said first and said second chemical compositions thereafter form a mixture within said second bottle;

(c) releasing said pressure upon said bridge member so as to permit said first and second aerosol valves to close;

(d) aligning said key member to said second position to remove said transfer groove from communication with said first and said second aerosol valves while moving said distribution duct into fluid communication with said second aerosol valve; and (e) applying a sufficient downward force upon said body portion of said bridge member to open said second aerosol valve and permit said mixture to flow out of said second bottle through said second valve and to thereafter exit said sprayer device through said spray nozzle.

12. A sprayer device comprising:

(a) first and second receptacles configured and adapted to contain, respectively, a first and a second composition, said first receptacle containing said first composition under a substantially positive internal pressure and said second receptacle containing said second composition under a comparatively lower internal pressure, said compositions being maintained within said receptacles at said positive internal pressure and said comparatively lower internal pressure, respectively, by corresponding valve means operatively associated with each said receptacle;

(b) said corresponding valve means comprising a first valve means associated with said first receptacle and a second valve means associated with second receptacle, said first and said second valve means adapted for controlling a flow of said first and said second composition from respectively, said first and said second receptacle, each said valve means being at least partially inserted within a neck portion of a corresponding one of said receptacles in a manner so as to achieve a gas-tight connection therebetween;

(c) a bridge member comprising a three-way valve having at least two operating positions comprising a first position providing for fluid communication between said first and said second valve means, and a second position to permit dispensing said mixture from said second receptacle through a spray nozzle, and a closed position; and (d) said three-way valve adapted to permit a flow of said first composition from said first receptacle to said second receptacle to form a mixture therein with said second composition and thereafter to dispense said mixture from said second receptacle through said spray nozzle, said three-way valve comprising an inner joining conduit for engaging a lateral output orifice located upon each of a pair of head members defined by said bridge member, so as to form a connection with both said head members at an angle of substantially 90 degrees to internal channel means located therein and wherein both said head members are, as a result, maintained in parallel, side-by-side alignment with one another along their vertical axis.

13. The device according to claim 12 which further comprises a rotatable sleeve at least partially encompassing said inner joining conduit, said rotatable sleeve defining a first pair of internal apertures, aligned by rotating said sleeve with a second pair of corresponding apertures located upon said inner joining conduit, said apertures adapted to permit said mixture to pass therethrough.

14. The device according to claim 13 wherein said rotatable sleeve is symmetrically constructed to permit said sleeve to be reversibly installed within said bridge member and further wherein said sleeve additionally defines a third internal aperture adapted for permitting fluid communication with said second pair of apertures when said sleeve is installed in said reversed position within said bridge member.

15. The device according to claim 13 wherein said rotatable sleeve further comprises an elongated duct extending substantially perpendicularly therefrom and in fluid communication with said inner joining conduit through said first pair of apertures and having, at a terminal end furtherest removed from said inner joining conduit, said spray nozzle adapted for dispensing said mixture from said device.

16. The device according to claim 15 further comprising casing means for supporting and enclosing said receptacles.

17. The device according to claim 16 wherein said receptacles are of differing height.

18. The device according to claim 17 wherein said first and said second valve means each comprise a tubeless valve.

19. A method for operating the sprayer device of claim 18 which comprises:

(a) positioning said elongated duct within said casing between said first and said second receptacles;

(b) exerting a sufficient downward force upon a body portion of said bridge member to simultaneously open said first and said second tubeless valves for a sufficient time to permit said first composition to exit said first receptacle through said first valve and to flow through said inner joining conduit so as to enter said second receptacle through said second valve, such that said first and said second compositions thereafter form a mixture within said second receptacle;

(c) releasing said pressure upon said bridge member to permit said first and said second tubeless valves to close;

(d) rotating said rotatable sleeve around said inner joining conduit so as align said first pair of apertures defined thereby with said second pair of apertures upon said inner joining conduit, thus forming a passage for said mixture to flow through and into said elongated duct; and (e) applying a sufficient downward force upon said body portion to open said second valve and to permit said mixture to pass out of said second receptacle through said second tubeless valve and to exit said sprayer device through said spray nozzle.

20. A sprayer device comprising:

(a) first and second receptacles configured and adapted to contain, respectively, a first and a second composition, said first receptacle containing said first composition under a substantially positive internal pressure and said second receptacle containing said second composition under a comparatively lower internal pressure, said compositions being maintained within said receptacles at said positive internal pressure and said lower internal pressure by corresponding valve means operatively associated with each said receptacle;

(b) said corresponding valve means comprising a first valve means associated with said first receptacle and a second valve means associated with said second receptacle, each said valve means being at least partially inserted within a neck portion of a corresponding one of said receptacles in a manner so as to achieve a gas-tight connection therebetween;

(c) a bridge member comprising a three-way valve having a first position providing for fluid communication between said first and said second valve means, a second position to permit dispensing said mixture from said second receptacle through a spray nozzle and a third closed position;

(d) said three-way valve adapted to permit a flow of said first composition from said first receptacle into said second receptacle to form a mixture therein with said second composition and thereafter to dispense said mixture from said second receptacle through said spray nozzle located upon a first terminal portion of said bridge member.

21. The device according to claim 20 wherein said bridge member comprises:

(a) a body portion forming a housing which defines first and second valve seats adapted and configured for operatively engaging, respectively, said first and said second valve means, each said valve means communicating with corresponding channel means configured for directing a fluid flow through said first and said second valve means, each said channel means extending substantially perpendicularly from said valve seat to said three-way valve, the vertical axis of both said channel means being in substantially parallel alignment with each other; and (b) said three-way valve comprised of a rotatable key member inserted within a bore defined by said body portion, said key member being rotatable to a first position within said bridge member to allow said first composition to pass out of said first receptacle through said first valve means and to enter said second receptacle through said second valve means to permit the formation of a mixture therebetween, and thereafter to a second position to permit said mixture to exit said second receptacle through said second valve means and to subsequently be dispensed from said device through said spray nozzle.

22. The device according to claim 21 wherein said key member comprises:

(a) a longitudinal transfer groove configured for simultaneous fluid communication with said first and said second valve means when said key member is aligned at said first position;

(b) a distribution duct adapted to be in fluid communication at a first end thereof with said second valve means when said key member is rotated to said second position, said distribution duct communicating at a second end thereof with said spray nozzle on said terminal portion of said bridge member; and (c) an operating button located at a second terminal portion of said bridge member, opposite said spray nozzle, adapted for rotating said key member to said first and said second operating positions.

23. The device according to claim 22 wherein said bridge member further comprises at least one stop cam member formed integral with a skirt portion of said operating button and extending downwardly therefrom into a groove defined by the body portion of said bridge member, said at least one stop cam member being adapted to define said first and said second operating position of said key member.

24. The device according to claim 22 wherein each said valve means comprises:

(a) an atomizer configured for insertion within a corresponding valve seat and operated by a downward pressure applied to said body portion of said bridge member, which causes the valve to open and thus permits the composition within the corresponding receptacle to exit said receptacle through the channel means communicating with said valve seat and to flow into said longitudinal transfer groove when said key member is in said first position or said distribution duct when said key member is in said second position; and (b) an elongated cylindrical tube member having a first end and a second end, said first end being attached to said valve means and said second end extending into a corresponding one of said receptacles and terminating substantially adjacent a bottom portion thereof.

25. The device according to claim 20 wherein said second receptacle is substantially larger than said first receptacle to provide a sufficient available volume within said second receptacle for entry of said first composition upon the operation of said device.

26. The device according to claim 20 wherein said first composition is initially dispersed within a liquid medium prior to placing it in said first receptacle, said dispersion being substantially entrained in a carrier gas within said first receptacle to facilitate its transport to said second receptacle.

27. The device according to claim 20 wherein said second composition is maintained within said second receptacle under vacuum conditions.

* * * * *